US011236281B2

(12) United States Patent
Rogel et al.

(10) Patent No.: US 11,236,281 B2
(45) Date of Patent: Feb. 1, 2022

(54) PRODUCTION OF STABLE FUEL OILS

(71) Applicant: CHEVRON U.S.A. INC., San Ramon, CA (US)

(72) Inventors: Estrella Rogel, Orinda, CA (US); Kyle Matthew Hench, Alameda, CA (US); Christopher J. Wilson, San Ramon, CA (US); David A. Dahlin, San Ramon, CA (US); Michael Moir, San Rafael, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 16/801,374

(22) Filed: Feb. 26, 2020

(65) Prior Publication Data

US 2020/0385644 A1 Dec. 10, 2020

Related U.S. Application Data

(60) Provisional application No. 62/859,389, filed on Jun. 10, 2019.

(51) Int. Cl.
*C10L 1/12* (2006.01)
*C10L 1/04* (2006.01)

(52) U.S. Cl.
CPC ..... *C10L 1/1275* (2013.01); *C10L 1/04* (2013.01); *C10L 2200/0263* (2013.01); *C10L 2200/0446* (2013.01); *C10L 2230/08* (2013.01); *C10L 2270/026* (2013.01); *C10L 2290/24* (2013.01); *C10L 2290/60* (2013.01)

(58) Field of Classification Search
CPC .... C10G 2300/1059; C10G 2300/1077; C10G 2300/202; C10G 2300/302; C10G 2300/304; C10G 2300/308; C10G 2300/44; C10G 2400/04; C10G 75/00; C10L 1/04; C10L 1/08; C10L 1/1275; C10L 2200/0263; C10L 2200/0446; C10L 2230/08; C10L 2270/026; C10L 2290/24; C10L 2290/60
See application file for complete search history.

(56) References Cited

U.S. PATENT DOCUMENTS

| | | | | |
|---|---|---|---|---|
| 7,618,822 | B2 | 11/2009 | Nemana et al. | |
| 8,916,041 | B2 | 12/2014 | Van Den Berg et al. | |
| 9,624,448 | B2 | 4/2017 | Joo et al. | |
| 2008/0043240 | A1 | 2/2008 | Reminiac et al. | |
| 2013/0161233 | A1 | 6/2013 | Bennett et al. | |
| 2015/0337226 | A1* | 11/2015 | Droubi | C10L 10/02 585/13 |
| 2018/0156772 | A1* | 6/2018 | Balashanmugam | C10G 75/00 |
| 2019/0040329 | A1* | 2/2019 | Moore | C10G 69/04 |
| 2019/0185772 | A1* | 6/2019 | Berkhous | C10G 45/02 |

OTHER PUBLICATIONS

PCT International Search Report, International Appl. No. PCT/IB2020/052902, dated May 29, 2020.

J.J. Heithaus "Measurement and Significance of Asphaltene Peptization" J. I. Petrol. 1962, 48, 45-53.

E. Rogel, K. Hench, P. Hajdu and H. Ingham "The Role of Compatibility in Determining the Blending and Processing of Crude Oils" ACS Symposium Series, 2019, vol. 1320, Chapter 7, 201-222.

* cited by examiner

*Primary Examiner* — Latosha Hines

(57) ABSTRACT

Low sulfur marine fuel compositions and methods for making the same are provided. The compositions exhibit a sulfur content of at most 0.50 wt. %, a solvent power of at least 0.30, and a P-value of at least 1.15.

12 Claims, No Drawings

PRODUCTION OF STABLE FUEL OILS

CROSS-REFERENCE TO RELATED APPLICATIONS

This application claims priority to and the benefit of U.S. Provisional Application Ser. No. 62/859,389, filed Jun. 10, 2019.

FIELD

This disclosure relates to marine fuel compositions having relatively low sulfur content, and methods for forming such compositions.

BACKGROUND

International Maritime Organization (IMO) regulations to reduce sulfur oxides ($SO_x$) emissions from marine vessels first came into force in 2005, under Annex VI of the International Convention for the Prevention of Pollution from Ships (known as the MARPOL Convention). Since then, the limits on sulfur oxides have been progressively lowered. Under the revised MARPOL Annex VI regulations, the sulfur limit for fuel oil used by marine vessels in designated Emission Control Areas (ECAs) was reduced to 0.10 wt. % (effective 1 Jan. 2015). For marine vessels operating outside of designated ECAs, the global sulfur cap for fuel oil was set by Annex VI at 3.50 wt. % (effective 1 Jan. 2012) with a further reduction to 0.50 wt. % (effective 1 Jan. 2020). It is noted that this latter 0.50 wt. % sulfur content cap corresponds to a global regulation that affects all non-ECA fuels unless an alternative mitigation method is in place, such as an on-board scrubber.

Conventionally, marine fuel oils are formed at least in part by using residual or heavy oil fractions. Due to the high sulfur content of many types of these fractions, some type of additional processing and/or blending is often required to form low sulfur fuel oils (0.50 wt. % or less sulfur). Conventionally, blending with one or more low sulfur fractions is typically used to adjust the sulfur content of the resulting blended fuel. In addition to reducing the sulfur content of the resulting blended fuel, blending in a low sulfur fraction can also modify the viscosity, density, combustion quality (Calculated Carbon Aromaticity Index or CCAI), pour point, and/or other properties of the fuel. Because having lower pour point and/or viscosity is often beneficial for improving the grade of the marine fuel oil, blending can often be preferable to performing severe hydrotreating on a residual fraction in order to meet a target sulfur level of 0.50 wt. % or less.

Although conventional strategies for blending low sulfur fractions with residual fractions can be useful for achieving a desired fuel oil sulfur target, blending with sufficient low sulfur fractions to produce a low sulfur fuel oil can potentially cause difficulties for stability. Some economically attractive low sulfur blendstocks can have relatively low aromatic contents along with a limited content of multi-ring naphthenes and/or aromatics. Residual and heavy fractions are composed primarily of four types of hydrocarbons: saturates (primarily non-polar straight chain hydrocarbons, branched chain hydrocarbons, and cyclic paraffins), aromatics (including fused benzene rings compounds), resins (polar aromatic rings systems containing nitrogen, oxygen, or sulfur), and asphaltenes (highly polar, complex aromatic ring compounds with varying composition, containing nitrogen, oxygen, and sulfur). The saturates, aromatics, and resins are sometimes collectively referred to as maltenes. The asphaltene fraction is defined as the portion that is not soluble in paraffinic solvents such as n-pentane, n-heptane or isooctane. Generally, asphaltenes exist as a colloidal suspension stabilized by maltenes (especially, resins). Such residual or heavy oil fractions may not be fully compatible when blended with some low sulfur fractions, resulting in a fuel blend that may form precipitated asphaltenes under certain conditions. Precipitation of asphaltenes can lead to equipment fouling, operational issues, and difficulties with storage and handling.

It would be advantageous to develop marine fuel oils, and corresponding methods of forming marine fuel oils, that have increased stability and compatibility when additional low sulfur blend stocks are added to the marine fuel oils.

SUMMARY

In one aspect, there is provided a marine fuel oil composition having a sulfur content of at most 0.50 wt. %, a solvent power ($P_o$) of at least 0.30, and a P-value of at least 1.15.

In another aspect, there is provided a marine fuel oil composition having a sulfur content of 0.50 wt. % or less, a solvent power ($P_o$) of at least 0.30, and a P-value of at least 1.15, wherein the marine fuel oil composition comprises (a) 15 wt. % or less of a residuum hydrocarbon component comprising at least one of solvent deasphalted residue, deasphalted oils, atmospheric tower bottoms, and vacuum tower bottoms; (b) 15 to 65 wt. % of a gas oil component comprising at least one of non-hydrotreated vacuum gas oil, hydrotreated vacuum gas oil, and straight-run gas oil; (c) 15 to 85 wt. % of an aromatic feedstock component comprising at least one of ethylene cracker bottoms, slurry oil, heavy cycle oil, and light cycle oil; and (d) 30 wt. % or less of a hydroprocessed hydrocarbon component comprising at least one of waxy light neutral hydrocrackate, diesel, and jet fuel.

In yet another aspect, there is provided a marine fuel oil composition having a sulfur content of 0.50 wt. % or less, a solvent power ($P_o$) of at least 0.30, and a P-value of at least 1.15, wherein the marine fuel oil composition comprises (a) 15 wt. % or less of a residuum hydrocarbon component comprising at least one of solvent deasphalted residue, deasphalted oils, atmospheric tower bottoms, and vacuum tower bottoms; (b) 15 to 70 wt. % of a crude oil; (c) 75 wt. % or less of an aromatic feedstock component comprising at least one of ethylene cracker bottoms, slurry oil, heavy cycle oil, and light cycle oil; and (d) 25 wt. % or less of a hydroprocessed hydrocarbon component comprising distillate.

In a further aspect, there is provided method of reducing the fouling propensity of a residuum hydrocarbon component, the method comprising: (a) determining the sulfur content, solvent power, and P-value of the residuum hydrocarbon component and at least one other hydrocarbon component; (b) selecting the at least one other hydrocarbon component such that a blend of the residuum hydrocarbon component and the at least one other hydrocarbon component has a calculated sulfur content of at most 0.50 wt. %, a calculated solvent power ($P_o$) of at least 0.30, and a calculated P-value of at least 1.15; and (c) blending the residuum hydrocarbon component and the at least one other hydrocarbon component in order to prepare a blend of low fouling propensity such that the blend has a sulfur content of at most 0.50 wt. %, a solvent power of at least 0.30, and a P-value of at least 1.15.

DETAILED DESCRIPTION

Definitions

The term "solvent power" as used herein generally refers to the ability of a solvent to dissolve solutes. For example, a fluid that has a high solvent power for asphaltenes means that the fluid has a greater ability to dissolve or maintain asphaltenes in colloidal dispersion than a fluid that has a low solvent power for asphaltenes.

The term "crude oil" refers to petroleum extracted from geologic formations in its unrefined form. The term crude oil will also be understood to include crude oil which has been subjected to water-oil separations and/or gas-oil separation and/or desalting and/or stabilization. One measure of the heaviness or lightness of a liquid hydrocarbon is American Petroleum Institute (API) gravity. According to this scale, light crude oil can be defined as having an API gravity (ASTM D287) greater than 31.1°, medium oil can be defined as having an API gravity between 22.3° and 31.1°, heavy crude oil can be defined as having an API gravity below 22.3°, and extra heavy oil can be defined with API gravity below 10.0°.

The term "residuum" refers to any hydrocarbon which has an initial boiling point greater than 343° C., such as atmospheric or vacuum tower bottoms, resin, pitch cuts from a solvent deasphalting (SDA) unit, visbreaker, or thermal cracking unit residue. An "atmospheric tower bottoms" can mean a hydrocarbon material obtained from the bottoms of an atmospheric crude distillation column. Generally, atmospheric residue is high in coke precursors and metal contamination. Often, an atmospheric tower bottoms has a boiling range with an initial boiling point of about 343° C., a T5 of about 343° C. to about 360° C., and a T95 of about 700° C. to about 900° C. The term "T5" or "T95" means the temperature at which 5 mass % or 95 mass %, as the case may be, respectively, of the sample boils. A "vacuum tower bottoms" can mean a hydrocarbon material boiling above about 524° C. and can include one or more $C_{40+}$ hydrocarbons.

The term "gas oil" refers to a hydrocarbon material boiling in a range of about 204° C. to about 524° C. This may be derived as side cuts from a vacuum distillation column in the fractionation section.

The term "straight-run" refers to fractions derived directly from an atmospheric distillation unit, optionally subjected to steam stripping, without other refinery treatment such as hydroprocessing, fluid catalytic cracking or steam cracking.

The term "vacuum gas oil" and its acronym "VGO" refers to a hydrocarbon material boiling in the range of about 343° C. to about 565° C. and can include one or more $C_{18}$ to $C_{50}$ hydrocarbons. The VGO may be prepared by vacuum fractionation of an atmospheric residue. Such a fraction is generally low in coke precursors and heavy metal contamination, which can serve to contaminate catalyst. Often, a VGO has a boiling range with an initial boiling point of about 340° C., a T5 of about 340° C. to about 350° C., a T95 of about 555° C. to about 570° C., and an end point of about 570° C.

The term "distillate" comprises a mixture of diesel and jet-range hydrocarbons and can include hydrocarbons having a boiling point temperature in the range of about 150° C. to about 400° C. atmospheric equivalent boiling point (AEBP), as determined by any standard gas chromatographic simulated distillation method such as ASTM D2887.

The term "diesel" can include hydrocarbons having a boiling point temperature in the range of about 250° C. to about 400° C. AEBP, as determined by any standard gas chromatographic simulated distillation method such as ASTM D2887.

The term "jet-range hydrocarbons" or "jet fuel" can include hydrocarbons having a boiling point temperature in the range of about 130° C. to about 300° C. (e.g., 150° C. to 260° C.) AEBP, as determined by any standard gas chromatographic simulated distillation method such as ASTM D2887. Additionally, the terms "jet-range hydrocarbons" or "jet fuels" can refer to a mixture of primarily $C_8$ to $C_{16}$ hydrocarbons with a maximum freezing point of −40° C. (e.g., Jet A) or −47° C. (e.g., Jet A−1).

The term "heavy cycle oil" and its acronym "HCO" refer a hydrocarbon material which is produced by fluid catalytic cracking (FCC) units. The distillation cut for this stream is, for example, in a range of about 330° C. to 510° C. HCO can include one or more $C_{16}$ to $C_{25}$ hydrocarbons.

The term "light cycle oil" and its acronym "LCO" refer to a hydrocarbon material produced by FCC units. The distillation cut for this stream is, for example, in a range of about 220° C. to 330° C. LCO can include one or more $C_{13}$ to $C_{18}$ hydrocarbons.

The term "slurry oil" refers to a heavy aromatic by-product containing fine particles of catalyst from the operation of an FCC unit, and may include both unclarified slurry oils and slurry oils that have been clarified to remove or reduce their fine particle content. Slurry oils are sometimes referred to as carbon black oils, decant oils or FCC bottom oils.

When determining a boiling point or a boiling range for a feed or product fraction, an appropriate ASTM test method can be used, such as the procedures described in ASTM D1160, D2887, D2892, or D86.

The term "weight percent", "wt. %", "percent by weight", "% by weight", and variations thereof, as used herein, refer to the concentration of a substance as the weight of that substance divided by the total weight of the composition and multiplied by 100.

Fuel Oil Stability and Compatibility

Solubility analysis can be used as a guideline to evaluate the stability and compatibility of fuel oils. As used herein, "stability" relates to the ability of an oil to maintain asphaltenes in a peptized (i.e., colloidally dispersed) or dissolved state and not undergo flocculation (i.e., the aggregation of colloidally dispersed asphaltenes into visibly larger masses which may or may not settle) or precipitation with changing process conditions or over time. A more stable oil will have a lower propensity to form fouling material. As used herein, "compatibility" refers to the ability of two or more oils to blend together within certain concentration ranges without evidence of separation, such as the formation of multiple phases. Incompatible oils, when mixed or blended, result in flocculation or precipitation of asphaltenes. Some oils may be compatible within certain concentration ranges, but incompatible outside of those ranges.

Stability and compatibility of fuel oils can be quantified by means known in the art such as determination of the three Heithaus compatibility parameters: asphaltene peptizability ($P_a$); maltene solvent power ($P_o$); and asphalt state of peptization (P). The P-value represents the overall compatibility of the system and is an indication of the stability or available solvency power of an oil with respect to precipitation of asphaltenes. If P>1, the asphaltenes are peptized and the system is stable. $P_a$ represents the tendency of asphaltenes to exist as a stable dispersion in a maltene solvent. A large value of $P_a$ means that the asphaltenes are relatively easy to solubilize. $P_o$ represents the ability of a maltene solvent to disperse asphaltenes and indicates the proportion of an aromatic/non-aromatic mixture that has solvent power equal to that of the sample.

Any known empirical solvent scale can be used to evaluate the compatibility parameters, such as titrimetric methods (e.g., ASTM D6703, ASTM D7060, ASTM D7112, ASTM D7157), the characterization K factor (UOP375), the Kauri-Butanol value (ASTM D1133), and aniline point (ASTM D611). According to the present disclosure, the compatibility parameters were determined according to ASTM D6703.

There are alternative ways to represent the parameters. For example, instead of using $P_a$, the solvent requirement of asphaltenes ($R_a$) can be used and defined as $R_a=FR_{max}$, where $FR_{max}$ represents the maximum flocculation ratio. $FR_{max}$ is the minimum required solvency power of a solvent mixture, expressed as a ratio by volume of aromatic solvent (e.g., toluene) to aromatic solvent plus paraffinic solvent (e.g., n-heptane) to keep the asphaltenes in an oil colloidally dispersed. If the system is stable, the solvent requirement of the asphaltenes will be lower than the solvent power of the maltenes ($P=P_o/R_a$).

An important quality consideration for a fuel oil is the propensity of the fuel oil to maintain asphaltenes in a peptized state and prevent their flocculation when stored or when blended with other oils. This phenomenon is known as the stability reserve of the fuel. Components for the marine fuel oil composition can be selected and blended in such a way that the resulting composition has an asphaltene stability reserve of at least 15%, meaning that the composition has a P-value of at least 1.15. In some aspects, an asphaltene stability reserve of at least 30% is targeted, meaning that the composition has a P-value of at least 1.30. The composition can have a P-value of at least 1.30, at least 1.35, or at least 1.40 The upper limit of the P-value typically does not exceed a value of 2.50. A fuel oil with a low stability reserve is more likely to undergo flocculation of asphaltenes when stressed (e.g., extended heated storage) or blended with a range of other oils.

Based on regular solution theory, the solvent power or solubility parameter of a blend with n components can be calculated using Equation (1):

$$P_{o(blend)}=\Sigma_{i=1}^{n}\varphi_i(P_o)_i \quad (1)$$

where $P_{o(blend)}$ is the solvent power or solubility parameter of the blend, $\varphi_i$ is the volume fraction of component i, and $(P_o)_i$ is the solvent power of component i.

Equation (1) can thus be used to predict the solvent power of a multi-component fuel oil and allow for the selection of one or more components that can be blended to produce a stable and compatible fuel oil.

Components for the marine fuel oil composition can be selected and blended in such a way that the resulting composition has a solvent power ($P_{o(blend)}$ of at least 0.30 (e.g., at least 0.35, at least 0.40, at least 0.45, at least 0.50, at least 0.55, at least 0.60, at least 0.65). A fuel oil with a solvent power of less than 0.30 is more likely to undergo flocculation of asphaltenes when stressed (e.g., extended heated storage) or blended with a range of other oils.

Additionally or alternatively, fuel oil stability can be evaluated according to ASTM D4740 in which cleanliness and compatibility of residual fuels are determined by spot test. In this test method, a spot rating of 1 is the highest rating and a spot rating of 5 is the lowest rating. A spot rating of 3 or 4 or 5 on a finished fuel oil indicates that the fuel contains excessive suspended solids and is likely to cause operating problems. Evidence of incompatibility is indicated by a spot rating of 3 or 4 or 5 when a fuel is mixed with a blend stock. The present marine fuel oil composition can have a spot rating of 1 or 2, according to ASTM D4740.

Marine Fuel Oil Compositions

In some aspects, the marine fuel oil composition can comprise (a) 15 wt. % or less (e.g., 10 wt. % or less, 5 to 15 wt. %, 5 to 12.5 wt. %) of a residuum hydrocarbon component comprising at least one of solvent deasphalted residue, deasphalted oils, atmospheric tower bottoms, and vacuum tower bottoms; (b) 15 to 65 wt. % (e.g., 30 to 60 wt. %, or 35 to 55 wt. %) of a gas oil component comprising at least one of non-hydrotreated vacuum gas oil, hydrotreated vacuum gas oil, and straight-run gas oil; (c) 15 to 85 wt. % (e.g., 15 to 60 wt. %, 15 to 50 wt. %, 25 to 60 wt. %, 25 to 50 wt. %, 30 to 60 wt. %, or 30 to 50 wt. %) of an aromatic feedstock component comprising at least one of ethylene cracker bottoms, slurry oil, heavy cycle oil, and light cycle oil; and (d) 30 wt. % or less (e.g., 20 wt. % or less, 10 wt. %. or less, 20 to 30 wt. %, 5 to 15 wt. %) of a hydroprocessed hydrocarbon component comprising at least one of waxy light neutral hydrocrackate, diesel, and jet fuel.

In some aspects, the marine fuel composition can comprise (a) 15 wt. % or less (10 wt. % or less, 5 to 15 wt. %, 5 to 12.5 wt. %) of a residuum hydrocarbon component comprising at least one of solvent deasphalted residue, deasphalted oils, atmospheric tower bottoms, and vacuum tower bottoms; (b) 15 to 70 wt. % (e.g., 20 to 70 wt. %, 20 to 60 wt. %, 20 to 50 wt. %, 20 to 30 wt. %, 40 to 70 wt. %, or 40 to 60 wt. %) of a crude oil; (c) 75 wt. % or less (e.g., 5 to 75 wt. %, 10 to 75 wt. %, 20 to 75 wt. %, 30 to 75 wt. %, 5 to 60 wt. %, 10 to 60 wt. %, 20 to 60 wt. %, 30 to 60 wt. %, 5 to 50 wt. %, 10 to 50 wt. %, 20 to 50 wt. %, or 30 to 50 wt. %) of an aromatic feedstock component comprising at least one of ethylene cracker bottoms, slurry oil, heavy cycle oil, and light cycle oil; and (d) 25 wt. % or less (e.g., 20 wt. % or less, 15 wt. %. or less, 10 to 25 wt. %, 10 to 20 wt. %) of a hydroprocessed hydrocarbon component comprising distillate.

Solvent deasphalted residue (e.g., SDA cut tar) may exhibit one or more of the following properties: (a) an API gravity of 3° to 6°; (b) a kinematic viscosity (ASTM D445) of 700 to 2500 $mm^2/s$ at 50° C.; (c) a density (ASTM D4052) of 934 to 1052 $kg/m^3$ at 15° C.; (d) a sulfur content (ASTM 4294) of 10,000 to 50,000 wppm; (d) a pour point (ASTM D97) of −5° C. to 13° C.; and (e) a flash point (ASTM D93B) of 80° C. to 110° C. Residual and heavy fractions may be deasphalted by methods known in the art, such as by use of fractionation, membrane technology or by solvent deasphalting, to remove asphaltenes and/or fractions boiling above about 566° C. The marine fuel oil composition may comprise up to 15 wt. % (e.g., 1 to 15 wt. %, 5 to 15 wt. %, 1 to 12.5 wt. %, or 5 to 12.5 wt. %) of solvent deasphalted residue.

Non-hydrotreated VGO may exhibit one or more of the following properties: (a) an API gravity of 10° to 15°; (b) a kinematic viscosity of 200 to 1000 $mm^2/s$ at 50° C.; (c) a density of 966 to 1000 $kg/m^3$ at 15° C.; (d) a sulfur content of 10,000 to 20,000 wppm; (d) a pour point of −5° C. to 90° C.; and (e) a flash point of greater than 200° C. The marine fuel oil composition may comprise up to 45 wt. % (e.g., up to 25 wt. %, 10 to 45 wt. %, 10 to 25 wt. %, 15 to 45 wt. %, or 15 to 25 wt. %) of non-hydrotreated VGO.

Hydrotreated VGO may exhibit one or more of the following properties: (a) an API gravity of 20° to 34°; (b) a kinematic viscosity of 10 to 70 $mm^2/s$ at 50° C.; (c) a density of 855 to 934 $kg/m^3$ at 15° C.; (d) a sulfur content of at most 1000 wppm; (d) a pour point of −25° C. to 120° C.; and (e)

a flash point of 45° C. to 300° C. The marine fuel oil composition may comprise up to 50 wt. % (e.g., up to 45 wt. %, up to 40 wt. %, 25 to 50 wt. %, 25 to 45 wt. %, 25 to 40 wt. %, 30 to 50 wt. %, 30 to 45 wt. %, or 30 to 45 wt. %) of hydrotreated VGO.

Straight-run gas oil may exhibit one or more of the following properties: (a) an API gravity of 20° to 34°; (b) a kinematic viscosity of 10 to 40 $mm^2/s$ at 50° C.; (c) a density of 855 to 934 $kg/m^3$ at 15° C.; (d) a sulfur content of 1000 to 2000 wppm; (d) a pour point of 5° C. to 30° C.; and (e) a flash point of 100° C. to 220° C. The marine fuel oil composition may comprise at most 50 wt. % (e.g., 25 to 50 wt. %, or 35 to 50 wt. %) of straight-run gas oil.

Aromatic feedstocks or process streams typically will contain at least 10% $C_A$ content and less than about 90% total $C_N$ plus $C_P$ content as measured according to ASTM D2140 or ASTM D3238, with the latter method typically being used for heavier petroleum fractions. The percentages of aromatic carbons (% $C_A$), naphthenic carbons (% $C_N$), and paraffinic carbons (% $C_P$) represent the weight percent of the total carbon atoms present in an oil that are combined in aromatic ring-type structures, naphthenic ring-type structures and paraffinic chain-type structures, respectively. The aromatic feedstock may contain at least 20% (e.g., at least 25% or at least 30%) $C_A$ content, and may be as high as 90% or more $C_A$ content. Exemplary aromatic feedstocks include ethylene cracker bottoms, slurry oil, heavy cycle oil, and light cycle oil.

Heavy cycle oil (HCO) may exhibit one or more of the following properties: (a) an API gravity of −5° to 8°; (b) a kinematic viscosity of 15 to 300 $mm^2/s$ at 50° C.; (c) a density of 1014 to 1119 $kg/m^3$ at 15° C.; (d) a sulfur content of at most 13,000 wppm; (d) a pour point of −8° C. to 30° C.; and (e) a flash point of 45° C. to 150° C. In some aspects, the marine fuel oil composition may comprise 15 to 50 wt. % (e.g., 25 to 50 wt. %, or 30 to 50 wt. %) of HCO.

Light cycle oil (LCO) may exhibit one or more of the following properties: (a) an API gravity of 6° to 20°; (b) a kinematic viscosity of 1 to 25 $mm^2/s$ at 50° C.; (c) a density of 934 to 1029 $kg/m^3$ at 15° C.; (d) a sulfur content of at most 7000 wppm; (d) a pour point of −34° C. to 20° C.; and (e) a flash point of 30° C. to 130° C. The marine fuel oil composition may comprise up to 10 wt. % (e.g., 1 to 10 wt. %, or 4 to 8 wt. %) of LCO.

Waxy light neutral hydrocrackate may exhibit one or more of the following properties: (a) an API gravity of 30° to 35°; (b) a kinematic viscosity of 20 to 40 $mm^2/s$ at 50° C.; (c) a density of 850 to 876 $kg/m^3$ at 15° C.; (d) a sulfur content of 5 to 300 wppm; (d) a pour point of 5° C. to 36° C.; and (e) a flash point of 100° C. to 220° C. The marine fuel oil composition may comprise up to 30 wt. % (e.g., 10 to 30 wt. %) of waxy light neutral hydrocrackate.

Hydrocracker bottoms (HCB) may exhibit have one or more of the following properties: (a) an API gravity of 30° to 40°; (b) a kinematic viscosity of 5 to 10 $mm^2/s$ at 50° C.; (c) a density of 825 to 876 $kg/m^3$ at 15° C.; (d) a sulfur content of at most 20 wppm; (d) a pour point of 10° C. to 25° C.; and (e) a flash point of 100° C. to 150° C. The marine fuel oil composition may comprise up to 20 wt. % (e.g., up to 15 wt. %, up to 12 wt. %, 1 to 20 wt. %, 1 to 15 wt. %, 5 to 15 wt. %, 1 to 12 wt. %, or 5 to 12 wt. %) of hydrocracker bottoms.

Diesel may exhibit one or more of the following properties: (a) an API gravity of 30° to 40°; (b) a kinematic viscosity of 1 to 5 $mm^2/s$ at 50° C.; (c) a density of 825 to 876 $kg/m^3$ at 15° C.; (d) a sulfur content of at most 15 wppm; (d) a pour point of −30° C. to −13° C.; and (e) a flash point of 40° C. to 80° C. The marine fuel composition may comprise at most 15 wt. % (e.g., 1 to 15 wt. %, 5 to 15 wt. %, 1 to 12 wt. %, or 5 to 12 wt. %) of diesel.

The jet fuel may conform to specifications for Jet A or Jet Fuel A−1, as described in ASTM D1655. The marine fuel composition may comprise 0 to 5 wt. % (e.g., greater than 0 to 5 wt. % or 1 to 5 wt. %) of jet fuel.

Crude oil may exhibit one or more of the following properties: (a) an API gravity of 10° to 22.3° (e.g., 15° to 20°); (b) a kinematic viscosity of 100 to 250 $mm^2/s$ at 50° C.; (c) a density of 935 to 966 $kg/m^3$ at 15° C.; (d) a sulfur content of 2000 to 4000 wppm; (d) a pour point of −10° C. to 20° C.; and (e) a flash point of 50° C. to 150° C. Suitable crude oils can include heavy, sweet crudes (oils with low hydrogen sulfide and carbon dioxide contents, usually containing less than 0.5% sulfur).

Distillate may exhibit one or more of the following properties: (a) an API gravity of 40° to 45°; (b) a kinematic viscosity of 1 to 1.5 $mm^2/s$ at 50° C.; (c) a density of 811 to 825 $kg/m^3$ at 15° C.; (d) a sulfur content of at most 15 wppm; and (d) a pour point maximum of −47° C. The marine fuel oil composition may comprise at most 15 wt. % (e.g., 1 to 15 wt. %, 5 to 15 wt. %, 1 to 12 wt. %, or 5 to 12 wt. %) of distillate.

Properties of the Marine Fuel Composition

The marine fuel oil composition can have a maximum sulfur content (ISO 8754 or ISO 14596 or ASTM D4294) of 0.50 wt. % (e.g., 0.49 wt. %, 0.48 wt. %, 0.47 wt. %, 0.46 wt. %, 0.45 wt. %, 0.44 wt. %, 0.43 wt. %, at 0.42 wt. %, 0.41 wt. %, 0.40 wt. %, 0.35 wt. %, 0.30 wt. %, 0.25 wt. %, 0.20 wt. %, 0.15 wt. %, 0.10 wt. %, 0.05 wt. %, or 0.01 wt. %) and/or a minimum sulfur content of 0.01 wt. %. (e.g., 0.05 wt. %, 0.10 wt. %, 0.15 wt. %, 0.20 wt. %, 0.25 wt. %, 0.30 wt. %, 0.35 wt. %, 0.40 wt. %, 0.41 wt. %, 0.42 wt. %, 0.43 wt. %, 0.44 wt. %, 0.45 wt. %, 0.46 wt. %, 0.47 wt. %, 0.48 wt. %, or 0.49 wt. %).

The low sulfur marine fuel oil composition can be formulated to be compliant with a standard specification, such as ISO 8217. To qualify as an ISO 8217: 2017 compliant fuel, the marine fuel oil composition must meet those internationally accepted standards including: a maximum kinematic viscosity at 50° C. (ISO 3104) of from 10.00 to 700.0 $mm^2/s$ (e.g., 10.00 to 180.0 $mm^2/s$); a maximum density at 15° C. (ISO 3675) of 920 to 1010.0 $kg/m^3$ (e.g., 920.0 to 991.0 $kg/m^3$); a Calculated Carbon Aromaticity Index (CCAI) of 850 to 870 (e.g., 850 to 860); a minimum flash point (ISO 2719) of 60.0° C.; a maximum total sediment—aged (ISO 10307−2) of 0.10 wt. %; a maximum carbon residue—micro method (ISO 10370) of 2.50 to 20.00 wt. % (e.g., 2.50 to 15.00); and a maximum aluminum plus silicon (ISO 10478) content of 25 to 60 mg/kg (e.g., 25 to 50 mg/kg). The sulfur content of the marine fuel oil composition can be significantly lower than 0.50 wt. % (i.e., ≤0.10 wt. % sulfur) to qualify as a MARPOL Annex VI (revised) ultra-low sulfur marine residual fuel for use in the ECA zones.

EXAMPLES

The following illustrative examples are intended to be non-limiting.

Examples 1-10

A series of marine fuel oil compositions were prepared. Table 1 shows the properties of blending components used in the marine fuel oil compositions of Examples 1-10.

TABLE 1

Characteristics of Respective Components in Examples 1-10

| Component | API Gravity (ASTM D287) | Kin. Visc. at 50° C., $mm^2/s$ (ASTM D445) | Pour Point, ° C. (ASTM D97) | Flash Point, ° C. (ASTM D93B) | Sulfur, wppm (ASTM D4294) | Asphaltenes, wt. % (ASTM D3279) |
|---|---|---|---|---|---|---|
| HCO 1 | −1.6 | 125.3 | −6 | 88 | 2702 | |
| HCO 2 | −1.4 | 133.7 | −6 | 138 | 8171 | |
| HCO 3 | 0.3 | 280.7 | 3 | 86 | 2150 | |
| HCO 4 | 0.6 | 213.7 | | | | |
| SDA Cut Tar | 5.7 | 1972 | −2 | 90 | 32140 | 14.23 |
| LCO | 10.3 | 3.371 | −34 | 122 | 17.4 | |
| Non-Hydrotreated VGO1 | 13.7 | 571.8 | −3 | 216 | 12160 | 0.00157 |
| Non-Hydrotreated VGO2 | 14.2 | 409 | | | | |
| Hydrotreated VGO 1 | 21.6 | 62.3 | | | | |
| Hydrotreated VGO 2 | 22.3 | 52.6 | 18 | >110 | 652 | |
| Hydrotreated VGO 3 | 22.9 | 37.29 | 35 | 140 | 817 | |
| Straight-Run Gas Oil | 26.9 | 32.64 | 20 | 122 | 1834 | |
| Waxy Light Neutral Hydrocrackate | 31.8 | 22.84 | 36 | 212 | 11.9 | |
| Diesel | 35.2 | 2.87 | −13 | 68 | 5.31 | |
| HCB 1 | 35.6 | 6.557 | | 128 | | |
| HCB 2 | 35.8 | 6.644 | 22 | 139 | 17.4 | |
| Jet Fuel | 41.7 | | −47 | 56 | <5 | |

Table 2 summarizes the blend content of the marine fuel oil compositions of Examples 1-11. Each blend contained a heavy cycle oil.

TABLE 2

| Component | Ex. 1, wt. % | Ex. 2, wt. % | Ex. 3, wt. % | Ex. 4, wt. % | Ex. 5, wt. % | Ex. 6, wt. % | Ex. 7, wt. % | Ex. 8, wt. % | Ex. 9, wt. % | Ex. 10, wt. % |
|---|---|---|---|---|---|---|---|---|---|---|
| HCO 1 | 32.8 | 39.1 | 41.5 | 39.4 | | | | | | |
| HCO 2 | | | | | 19.1 | 18.6 | | | | |
| HCO 3 | | | | | | | | | 38.2 | 44.5 |
| HCO 4 + HCO 1 | | | | | | | 38.5 | 44.3 | | |
| SDA Cut Tar | 10.4 | 9.9 | | | 6.7 | 6.7 | 10.4 | 9.8 | 10.7 | 10.5 |
| LCO | 6.7 | | | | | | 5.1 | | 5.1 | |
| Non-hydrotreated VGO 1 | | | 17.3 | 20.6 | | | | | | |
| Non-hydrotreated VGO 2 | | | | | | | | | 41.1 | |
| Hydrotreated VGO 1 + Hydrotreated VGO 3 | | | | | | | 36.8 | 43.1 | | |
| Hydrotreated VGO 2 | | | | | | | | | | 41.3 |
| Hydrotreated VGO 3 | 38.7 | 46.2 | 36.0 | 40.0 | | | | | | |
| Straight-Run Gas Oil | | | | | 46.1 | 46.3 | | | | |
| Waxy Light Neutral Hydrocrackate | | | | | 10.1 | 28.4 | | | | |
| Diesel | 11.4 | | | | | | 9.2 | | 4.9 | |
| HCB 1 | | | | | 18.0 | | | | | |
| HCB 2 | | | 5.2 | | | | | | | |
| Jet Fuel | | 4.8 | | | | | | 2.7 | | 3.7 |

Table 3 provides a summary of certain physical and chemical characteristics of the marine fuel oil compositions of Examples 1-10.

TABLE 3

| | API Gravity | $KV_{50}$, $mm^2/s$ | CCAI | Sulfur, wppm | Compatibility $P_o$ (Solvent Power) | Compatibility $R_a$ (Solvent Requirement) | Compatibility P (Compatibility) | Total Sediment (ASTM D4870) Thermal Aging (A) | Total Sediment (ASTM D4870) Chemical Aging (B) | Spot Number (ASTM D4740) | Asphaltenes, wt. %[2] |
|---|---|---|---|---|---|---|---|---|---|---|---|
| Ex. 1 | 13.8 | 25.56 | 871 | 4744 | 0.65 | 0.28 | 2.32 | 0.03 | 0.04 | 1 | 2.57 |
| Ex. 2 | 12.7 | 40.58 | 870 | 4595 | 0.66 | 0.29 | 2.26 | 0.03 | 0.03 | 1 | 2.52 |
| Ex. 3 | 12.0 | 56.55 | 870 | 3544 | 0.47 | [1] | | 0.05 | 0.06 | 1 | 0.69 |

TABLE 3-continued

| | API Gravity | $KV_{50}$, $mm^2/s$ | CCAI | Sulfur, wppm | Compatibility $P_o$ (Solvent Power) | Compatibility $R_a$ (Solvent Requirement) | Compatibility P (Compatibility) | Total Sediment (ASTM D4870) Thermal Aging (A) | Total Sediment (ASTM D4870) Chemical Aging (B) | Spot Number (ASTM D4740) | Asphaltenes, wt. %[2] |
|---|---|---|---|---|---|---|---|---|---|---|---|
| Ex. 4 | 11.5 | 72.73 | 870 | 3937 | 0.51 | [1] | | 0.04 | 0.03 | 1 | 0.67 |
| Ex. 5 (Comparative) | 22.2 | 29.08 | 815 | 4621 | 0.21 | 0.31 | 0.69 | 0.65 | 0.27 | 5 | 2.14 |
| Ex. 6 (Comparative) | 21.4 | 39.32 | 815 | 4641 | 0.21 | 0.31 | 0.68 | 0.73 | 0.28 | 5 | 2.09 |
| Ex. 7 | 12.8 | 43.69 | 868 | 4700 | 0.65 | 0.31 | 2.11 | | | 1 | |
| Ex. 8 | 11.8 | 76.11 | 868 | 4720 | 0.67 | 0.32 | 2.08 | | | 1 | |
| Ex. 9 | 12.3 | 55.08 | | 4590 | 0.46 | 0.30 | 1.53 | | | 1 | |
| Ex. 10 | 11.8 | 71.83 | | 4630 | 0.51 | 0.32 | 1.59 | | | 1 | |

[1] Asphaltene content was insufficient for compatibility test. A standard material containing asphaltenes was added and the solvent power was determined.
[2] Determined by in-line filter techniques, as described in U.S. Pat. No. 9,671,384.

As shown in Table 3, fuel oil compositions exhibiting a solvent power of less than 0.30 (Examples 5-6) have poor compatibility as evidenced by a P-value of less than 1.0, high amounts of total sediment, and poor spot testing rating results.

The invention claimed is:

1. A marine fuel oil composition having a sulfur content of at most 0.50 wt. %, a solvent power ($P_o$) of at least 0.30, and a P-value of at least 1.15; the marine fuel oil composition further comprising:

(a) 15 wt. % or less of a residuum hydrocarbon component comprising at least one of solvent deasphalted residue, deasphalted oils, atmospheric tower bottoms, and vacuum tower bottoms;

(b) 15 to 65 wt. % of a gas oil component comprising at least one of non-hydrotreated vacuum gas oil, hydrotreated vacuum gas oil, and straight-run gas oil;

(c) 15 to 85 wt. % of an aromatic feedstock component comprising at least one of ethylene cracker bottoms, slurry oil, heavy cycle oil, and light cycle oil; and (d) 30 wt. % or less of a hydroprocessed hydrocarbon component comprising at least one of waxy light neutral hydrocrackate, diesel, and jet fuel.

2. The marine fuel oil composition of claim 1, wherein the residuum hydrocarbon component is present in an amount of from 5 to 12.5 wt. %.

3. The marine fuel oil composition of claim 1, wherein the gas oil component is present in an amount of from 30 to 60 wt. %.

4. The marine fuel oil composition of claim 1, wherein the aromatic feedstock component is present in an amount of from 30 to 50 wt. %.

5. The marine fuel oil composition of claim 1, wherein the solvent power is at least 0.45.

6. The marine fuel oil composition of claim 1, wherein the P-value is at least 1.30.

7. A marine fuel oil composition of claim 2, having one or more properties selected from the group consisting of: (a) a maximum kinematic viscosity at 50° C. (ISO 3104) of 10.00 to 700.0 $mm^2/s$; 4(b) a maximum density at 15° C. (ISO 3675) of 920 to 1010.0 $kg/m^3$; (c) a maximum CCAI of 850 to 870; (d) a minimum flash point (ISO 2719) of 60.00 C; (e) a maximum total sediment—aged (ISO 10307-2) of 0.10 wt. %; (f) a maximum carbon residue—micro method (ISO 10370) of 2.50 to 20.00 wt. %; and (g) a maximum aluminum plus silicon (ISO 10478) content of 25 to 60 mg/kg.

8. A marine fuel oil composition having a sulfur content of at most 0.50 wt. %, a solvent power ($P_o$) of at least 0.30, and a P-value of at least 1.15; the marine fuel oil composition further comprising:

(a) 15 wt. % or less of a residuum hydrocarbon component comprising at least one of solvent deasphalted residue, deasphalted oils, atmospheric tower bottoms, and vacuum tower bottoms;

(b) 15 to 70 wt. % of a crude oil;

(c) 25 to 75 wt. % of an aromatic feedstock component comprising at least one of ethylene cracker bottoms, slurry oil, heavy cycle oil, and light cycle oil; and (d) 25 wt. % or less of a hydroprocessed hydrocarbon component comprising distillate.

9. The marine fuel oil composition of claim 8, wherein the residuum hydrocarbon component is present in an amount of from 5 to 12.5 wt. %.

10. The marine fuel oil composition of claim 8, wherein the aromatic feedstock component is present in an amount of from 30 to 50 wt. %.

11. The marine fuel oil composition of claim 8, wherein the crude oil has one or more of the following properties:

(a) an API gravity of 10° to 22.3°;

(b) a kinematic viscosity of 100 to 250 $mm^2/s$ at 50° C.;

(c) a density of 0.9350 to 0.9659 $kg/m^3$ at 15° C.;

(d) a sulfur content of 2000 to 4000 wppm;

(e) a pour point of −10° C. to 20° C.; and (f) a flash point of 50° C. to 150° C.

12. The marine fuel oil composition of claim 8, wherein the crude oil is present in an amount of from 20 to 30 wt. % or from 40 to 60 wt. %.

* * * * *